US011298630B2

(12) United States Patent
Guarino

(10) Patent No.: US 11,298,630 B2
(45) Date of Patent: Apr. 12, 2022

(54) SNOW-THEMED BOTTLE

(71) Applicant: Neil Guarino, Mount Sinai, NY (US)

(72) Inventor: Neil Guarino, Mount Sinai, NY (US)

( * ) Notice: Subject to any disclaimer, the term of this patent is extended or adjusted under 35 U.S.C. 154(b) by 0 days.

(21) Appl. No.: 16/936,993

(22) Filed: Jul. 23, 2020

(65) Prior Publication Data

US 2021/0060450 A1 Mar. 4, 2021

Related U.S. Application Data

(60) Provisional application No. 62/892,597, filed on Aug. 28, 2019.

(51) Int. Cl.

| | |
|---|---|
| ***A63H 33/42*** | (2006.01) |
| ***G09F 19/02*** | (2006.01) |
| ***B65D 23/12*** | (2006.01) |
| ***B65D 1/02*** | (2006.01) |
| ***B65D 81/36*** | (2006.01) |

(52) U.S. Cl.

CPC ..... *A63H 33/42* (2013.01); *B65D 1/0223* (2013.01); *B65D 23/12* (2013.01); *B65D 81/36* (2013.01); *G09F 19/02* (2013.01); *B65D 2203/00* (2013.01); *B65D 2583/0427* (2013.01)

(58) Field of Classification Search

CPC ..... A63H 33/42; B65D 23/12; B65D 1/023; B65D 81/36; B65D 2583/0427; B65D 2203/00; B65D 51/248; B65D 23/08; B65D 23/14

USPC ..... 446/220

See application file for complete search history.

(56) References Cited

U.S. PATENT DOCUMENTS

| | | | | |
|---|---|---|---|---|
| 3,975,845 | A * | 8/1976 | Mellard | A63H 13/20 40/414 |
| 4,641,445 | A | 2/1987 | Rossi | |
| 4,842,140 | A * | 6/1989 | Mesnard | B65D 1/02 206/457 |
| 4,961,276 | A | 10/1990 | Lin | |
| 5,132,844 | A * | 7/1992 | Sharp, Jr. | G02B 27/08 359/617 |
| 5,666,750 | A | 9/1997 | Segan et al. | |
| 5,711,099 | A | 1/1998 | Nesbit et al. | |
| 5,864,976 | A | 2/1999 | Yang | |
| 5,878,515 | A | 3/1999 | Yang | |

(Continued)

OTHER PUBLICATIONS

Melodrama, DIY Parton Bottle Snow Globe, published on Nov. 24, 2015 by Krys, https://melo-drama.com/2015/11/24/diy-patron-bottle-snow-globe/.*

*Primary Examiner* — Ernesto A Grano

(74) *Attorney, Agent, or Firm* — Gearhart Law LLC

(57) ABSTRACT

A snow-themed bottle comprising a middle portion located between a top and a bottom portion is described. An outer surface of the middle portion includes a first transparent viewing window located on a first side. The outer surface includes a slot component affixed to a second side disposed opposite the first side, the slot component housing a theme card. A hollow inner shell is disposed inside the outer surface where the inner shell houses a clear fluid, an ornament affixed to the bottom portion, and a plurality of particles. A second transparent viewing window is affixed to an inside portion of the hollow inner shell at the second side such that a user may view a front of the theme card through the first transparent viewing window and a back of the theme card through the second transparent viewing window.

19 Claims, 4 Drawing Sheets

(56) References Cited

U.S. PATENT DOCUMENTS 6,042,022 A * 3/2000 Rogozinski ..... B05B 11/0005 222/192
6,050,414 A * 4/2000 Saffron ..... A47G 19/2227 206/457
6,857,755 B1 * 2/2005 Lewis ..... A44C 15/0015 362/104
7,097,069 B2 * 8/2006 Cavanagh ..... B65D 7/04 206/217
7,430,823 B1 10/2008 Chung
7,740,368 B2 * 6/2010 Chiang ..... B65D 51/248 362/101
D629,714 S * 12/2010 Sicurelli ..... D11/128
8,002,129 B1 * 8/2011 Reyes ..... B65D 1/06 215/6
8,011,816 B1 * 9/2011 Janda ..... F21V 33/0036 362/375
8,550,869 B2 * 10/2013 Koonce, Jr. ..... A63H 27/10 446/219
8,770,776 B1 * 7/2014 Yang ..... G09F 19/08 362/101
8,992,281 B2 * 3/2015 Lui ..... A63H 3/50 446/72
D820,043 S * 6/2018 Leslie-Shattenkirk ..... B65D 1/0276 D7/507
2002/0012689 A1 * 1/2002 Stillman ..... B65D 85/812 424/439
2002/0029501 A1 * 3/2002 Braun ..... G09F 3/0292 40/310
2003/0008144 A1 * 1/2003 Whitney ..... B32B 7/02 428/402
2003/0168372 A1 * 9/2003 Headen ..... C03C 17/34 206/459.1
2003/0196357 A1 * 10/2003 Knapp ..... G09F 19/08 40/410
2004/0004829 A1 * 1/2004 Policappelli ..... G09F 13/20 362/101
2004/0124192 A1 * 7/2004 Teller ..... B65D 25/24 220/23.9
2004/0140286 A1 * 7/2004 Zoller ..... B65D 23/14 215/379
2004/0173559 A1 * 9/2004 Shih ..... B65D 23/08 215/12.2
2005/0039358 A1 2/2005 Rust
2005/0218102 A1 * 10/2005 Guilford ..... B65D 81/18 215/11.1
2005/0236423 A1 * 10/2005 VanGordon ..... B65D 23/14 222/78
2006/0028014 A1 * 2/2006 McQueeny ..... G09F 3/10 283/101
2006/0111011 A1 * 5/2006 Wang ..... G09F 19/02 446/220
2006/0249950 A1 * 11/2006 Kenney ..... B65D 23/08 283/81
2006/0286892 A1 * 12/2006 Moomaw ..... G09F 15/00 446/220
2007/0201220 A1 * 8/2007 Ulicny ..... B65D 23/00 362/101
2008/0034628 A1 * 2/2008 Schnuckle ..... B65D 23/085 40/310
2008/0035515 A1 * 2/2008 Dikopf ..... A47G 19/2227 206/457
2008/0160876 A1 * 7/2008 Hsu ..... G09F 19/02 446/220
2011/0024311 A1 * 2/2011 Swinford ..... B65D 23/12 206/221
2011/0092130 A1 * 4/2011 Hsu ..... G09F 19/02 446/267
2011/0268838 A1 * 11/2011 Vondrasek ..... C12H 1/22 426/15
2012/0067756 A1 * 3/2012 Jansen ..... B67D 1/0872 206/457
2012/0261379 A1 * 10/2012 Lenahan ..... B65D 23/102 215/228
2013/0269226 A1 * 10/2013 Volftsun ..... B65D 23/00 40/299.01
2014/0246395 A1 * 9/2014 Joubert ..... B65D 41/62 215/227
2015/0117930 A1 * 4/2015 Rasgon ..... A45D 34/045 401/129
2015/0377455 A1 * 12/2015 Yang ..... F21S 6/001 362/101
2017/0225821 A1 * 8/2017 Hynes ..... B65D 21/0237
2017/0326465 A1 * 11/2017 Mascarelli ..... B44C 5/005
2018/0327141 A1 * 11/2018 Deuser ..... B65D 23/102
2019/0133358 A1 * 5/2019 Clyde ..... A47G 19/2255
2019/0162979 A1 * 5/2019 Staton ..... B65D 25/54
2019/0177054 A1 * 6/2019 Duckworth ..... C12H 1/16
2019/0195783 A1 * 6/2019 Kawano ..... G01N 21/474
2020/0198829 A1 * 6/2020 Rizzo ..... B29B 11/14

* cited by examiner

SNOW-THEMED BOTTLE

PRIORITY CLAIM

This application claims priority to U.S. Application 62/892,597 filed on Aug. 28, 2019, the contents of which are herein fully incorporated by reference in its entirety.

FIELD OF THE EMBODIMENTS

The field of the invention and its embodiments relate to a snow-themed bottle or a snow globe. In particular, the present invention and its embodiments provide a user-customizable snow-themed bottle, where the user may customize a theme of the snow-themed bottle by modifying one or more theme cards insertable into the snow-themed bottle, parameters (e.g., a shape, a color, a size, or a texture) of particles located within the snow-themed bottle, and an ornament/miniaturized scene located within the snow-themed bottle.

BACKGROUND OF THE EMBODIMENTS

A snow globe is a common decorative device used and gifted frequently, especially during the holidays. Snow globes may be collected by adults and children for their antiquity and novelty. In some examples, a snow globe may be collected by a tourist as a souvenir and as a memory of travel to a new location. Snow globes typically consist of a transparent sphere enclosing a miniaturized scene, with a clear liquid medium and simulated "snow" particles. The sphere is typically mounted on a base. A user traditionally shakes the snow globe such that the particles rapidly move throughout the clear liquid medium and slowly fall to the base of the miniaturized scene.

Some snow globes contain a built-in music box that plays one or more songs. Other snow globes utilize a propeller or motor to circulate the clear liquid medium and the particles such that the user does not have to engage in the action of shaking the snow globe to watch the particles fall to the base like "snow." In other examples, the snow globe may comprise a frame housing a photograph, the frame capable of being slidably inserted into the center of the snow globe. The photograph may be viewed by a user when the user views the snow globe.

However, traditional snow globes fail to provide customizable options. If a user wishes to purchase a customized snow globe (e.g., for a birthday present or as a holiday gift), the user must request the customizability upon purchase and will likely spend a hefty amount for such personalization. In some scenarios, the recipient of the snow globe may wish to modify aspects of the snow globe, such as the miniaturized scene or ornament located within the snow globe, as a new holiday approaches. However, such modification is not traditionally possible. A need exists for a snow globe that may be user-customizable such that the product can appeal to a wide variety of customers, including children, adults, collectors, and tourists.

The present invention and its embodiments relate to a snow-themed bottle. In particular, the present invention and its embodiments provide a user-customizable snow-themed bottle, where the user may customize a theme of the snow-themed bottle by modifying one or more theme cards insertable into the snow-themed bottle, parameters (e.g., a shape, a color, a size, or a texture) of particles located within the snow-themed bottle, and an ornament/miniaturized scene located within the snow-themed bottle.

REVIEW OF RELATED TECHNOLOGY

U.S. Pat. No. 5,711,099 A pertains to a snow globe with a propeller capable of circulating a fluid and simulated snow particles around the snow globe.

U.S. Pat. No. 5,666,750 A pertains to an ornamental display device for simulating snowfall over a display object or a scene positioned within a housing. A liquid filled compartment is rotatably arranged within the housing. The liquid within the cavity is substantially transparent and snow-simulating flake particles are dispersed within the liquid.

Both U.S. Pat. Nos. 5,864,976 A and 5,878,515 A pertain to a driving mechanism of a snow globe containing a musical component such that one or more songs may be played during user interaction with the snow globe.

U.S. Patent Application Publication No. 2005/0039358 A1 describes a snow globe with enhanced viewing pleasure due to a significantly extended snowfall effect. The extended snowfall is achieved with the use of "snow reservoirs" at both the top and bottom of the snow globe. The simulated snow floats down out of the top reservoir at a restricted rate through holes into the viewed area of the snow globe and then into the snow reservoir at the bottom. After all the snow has settled into the bottom snow reservoir, the snow globe can be turned horizontally 180 degrees to instantly begin the simulated snowfall again.

U.S. Pat. No. 4,961,276 A describes an ornamental crystal ball. The crystal ball includes a base, a ball mounted on the base and filled with water, a model disposed in the ball, objects disposed in the ball, and a driving apparatus to flow the water and the objects.

U.S. Pat. No. 7,430,823 B1 describes a snow globe that includes a holder and a photo frame. The holder comprises a globe, a stand, and a base. The globe is transparent and comprises a slot, a frame mount, and a decoration comprising particles. The frame mount is mounted in the globe and the slot is formed through an outer surface of the globe. The photo frame is mounted slidably in the globe on the frame mount and has an openable backing and a window.

U.S. Pat. No. 4,641,445 A describes a novelty display device which simulates a snow fall. The device includes a base having a transparent container positioned on its top, which forms a substantially closed chamber. An electric motor is contained within the base and rotatably drives a fan blade contained within an adjacent bottom of the chamber. Lightweight particulate matter is disposed within the interior of the chamber so that, upon actuation of the fan blade, the fan blade inducts the particulate matter from the bottom of the chamber and circulates the particulate matter throughout the chamber, thereby simulating a snowfall.

Various snow globe devices are known in the art. Moreover, variations of the traditional snow globe are known in the art. However, their structure and means of operation are substantially different from the present disclosure, as the other inventions fail to solve all the problems taught by the present disclosure. The present invention and its embodiments relate to a snow-themed bottle. In particular, the present invention and its embodiments provide a user-customizable snow-themed bottle, where the user may customize a theme of the snow-themed bottle by modifying one or more theme cards insertable into the snow-themed bottle, parameters (e.g., a shape, a color, a size, or a texture) of particles located within the snow-themed bottle, and an ornament/miniaturized scene located within the snow-themed bottle.

SUMMARY OF THE EMBODIMENTS

The present invention and its embodiments relate to a snow-themed bottle. In particular, the present invention and its embodiments provide a user-customizable snow-themed bottle, where the user may customize a theme of the snow-themed bottle by modifying one or more theme cards insertable into the snow-themed bottle, parameters (e.g., a shape, a color, a size, or a texture) of particles located within the snow-themed bottle, and an ornament/miniaturized scene located within the snow-themed bottle.

A first embodiment of the present invention describes a snow-themed bottle. The snow-themed bottle includes a substantially cylindrical body portion located between a top portion and a bottom portion. The top portion may be located at a first end and the bottom portion may be located at a second end, where the second end is disposed opposite the first end. Further, the top portion may have a first width and both the substantially cylindrical body portion and the bottom portion may have a second width, such that a circumference of the first width is smaller than the circumference of the second width.

The substantially cylindrical body portion may include both an outer surface and a hollow inner shell. The outer surface may be substantially opaque in color yet may include a first transparent viewing window located on a first side of the outer surface. The outer surface may also include a slot component affixed to a second side of the outer surface, where the first side is disposed opposite the second side. In examples, the slot component may be configured to house a frame. In examples, the frame may be configured to house one or more theme cards where each theme card may include one or more images, colors, letters, text, etc.

The hollow inner shell may include an ornament or miniaturized scene affixed to the bottom portion, a clear fluid medium, and a plurality of particles. It should be appreciated that the particles may be made of any material, such as plastic. In some examples, the particles may be made of a polyvinyl chloride (PVC) material. According to this example, the hollow inner shell may also include a second transparent viewing window affixed to an inside portion of the hollow inner shell at the second side.

The top portion of the snow-themed bottle may extend from the substantially cylindrical body portion and may become tapered towards the first end. In examples, the top portion may include a neck portion, a closure portion, and an opening. The closure portion may be located at the first end. The neck portion may be located between the closure portion and the hollow inner shell. The neck portion may include an opening extending through the neck portion to the hollow inner shell of the substantially cylindrical body portion.

In other examples, the opening may be configured to house one or more lights. In examples, an outer portion of the neck portion may include a switch such that when the switch is turned to an on position, the one or more lights located within the opening are turned on and are configured to illuminate the hollow inner shell of the snow-themed bottle. The switch may include a button, toggle, or other mechanism configured to open or close a circuit to supply electricity to the one or more lights or other structures of the snow-themed bottle. In examples, an interior portion of the neck portion may also include a removable battery cartridge configured to charge the one or more lights.

A second embodiment of the present invention depicts a snow-themed bottle. The snow-themed bottle may include: a top portion, a bottom portion, and a middle portion located between the top portion and the bottom portion. The top portion may be located at a first end and the bottom portion may be located at a second end, such that the first end is disposed opposite the second end.

The middle portion may be of any shape, but may include: a globe shape, a cylindrical shape, or a rectangular shape. In examples, the middle portion may include both an outer surface and a hollow inner shell. The outer surface may include a first transparent viewing window located on a first side of the outer surface and a slot component affixed to a second side of the outer surface, where the first side is disposed opposite the second side. In examples, the slot component is configured to house a frame. One or more theme cards may be interchangeably placed within the frame. Each of the one or more theme cards may include one or more images, colors, letters, and text, among others.

The hollow inner shell may include a second transparent viewing window located inside and affixed to an inside portion of the hollow inner shell at the second side. The hollow inner shell may further include an ornament, or a miniaturized scene affixed to the bottom portion, a clear fluid medium, and a plurality of particles. The particles may be made of any material, such as a plastic material. In some examples, the particles may be made of a polyvinyl chloride (PVC) material.

In this example, each particle of the plurality of particles comprises a shape, where such shape may be a one-dimensional shape, a two-dimensional shape, and a three-dimensional shape. In some examples, when each particle of the plurality of particles is a two-dimensional shape, the two-dimensional shape may include: a henagonal shape, a diagonal shape, a triangular shape, a quadrilateral shape, a pentagonal shape, a hexagonal shape, a heptagonal shape, an octagonal shape, a nonagonal shape, a decagonal shape, a hendecagonal shape, a dodecagonal shape, a tridecagonal shape, a tetradecagonal shape, a pentadecagonal shape, a hexadecagonal shape, a heptadecagonal shape, an octadecagonal shape, an enneadecagonal shape, and an icosagonal shape. In other examples, the two-dimensional shape may include at least one circular arc. In this scenario, two-dimensional shape comprising the at least one arc may include: an annulus, an arbelos, a circle, a circular sector, a circular segment, a crescent, an indalo, a lense, a lune, a reuleaux polygon, a salinon, a semicircle, a tomahawk, and a triquetra.

Further, the particles may be of virtually any design including but not limited to symbols, characters, people, places, things, ideas, words, phrases, and punctuation.

In this example, the top portion may include a neck portion, a closure portion, and an opening. The closure portion may be located at the first end. The neck portion may be located between the closure portion and the hollow inner shell. The neck portion may include an opening extending through the neck portion to the hollow inner shell of the substantially cylindrical body portion.

In other examples, the opening may be configured to house one or more lights. In examples, an outer portion of the neck portion may include a switch such that when the switch is turned to an on position, the one or more lights located within the opening are turned on and are configured to illuminate the hollow inner shell of the snow-themed bottle. In examples, an interior portion of the neck portion may also include a removable battery cartridge configured to charge the one or more lights.

A third embodiment of the present invention describes a snow-themed bottle. In this embodiment, the snow-themed bottle includes: a top portion, a bottom portion, and a middle portion disposed between the top portion and the bottom portion. The top portion may be located at a first end and the bottom portion may be located at a second end, where the first end is disposed opposite the second end.

The middle portion may be of any shape, but may be a globe shape, a cylindrical shape, and a rectangular shape. In this example, the middle portion may include: an outer surface and an inner shell. The outer surface may include a first transparent viewing window located on a first side of the outer surface and a slot component affixed to a second side of the outer surface, where the first side is disposed opposite the second side.

In this example, the slot component may be configured to house a frame. One or more theme cards may be interchangeably located within the frame. Each theme card of the one or more theme cards may include one or more images, colors, letters, and text. In this example, the hollow inner shell may include a second transparent viewing window located inside and affixed to an inside portion of the hollow inner shell at the second side. The hollow inner shell may additionally include an ornament affixed to the bottom portion, a clear fluid medium, and a plurality of particles.

In general, the present invention succeeds in conferring the following benefits and objectives.

It is an object of the present invention to provide an infinitely user-customizable snow-themed bottle, where the user may customize and modify the one or more theme cards insertable into the snow-themed bottle.

It is an object of the present invention to provide an infinitely user-customizable snow-themed bottle, where the user may customize and modify a shape, a texture, a size and/or a color of particles located within the snow-themed bottle.

It is an object of the present invention to provide an infinitely user-customizable snow-themed bottle, where the user may customize and modify one or more aspects of the ornament or miniature scene located within the snow-themed bottle.

It is an object of the present invention to allow a user to create any unique theme or artistic expression the user wishes for the snow-themed bottle by customizing: the one or more theme cards insertable into the snow-themed bottle, parameters (e.g., a shape, a color, a size, or a texture) of particles located within the snow-themed bottle, and the ornament or miniature scene located within the snow-themed bottle.

DESCRIPTION OF THE PREFERRED EMBODIMENTS

Figure 1:
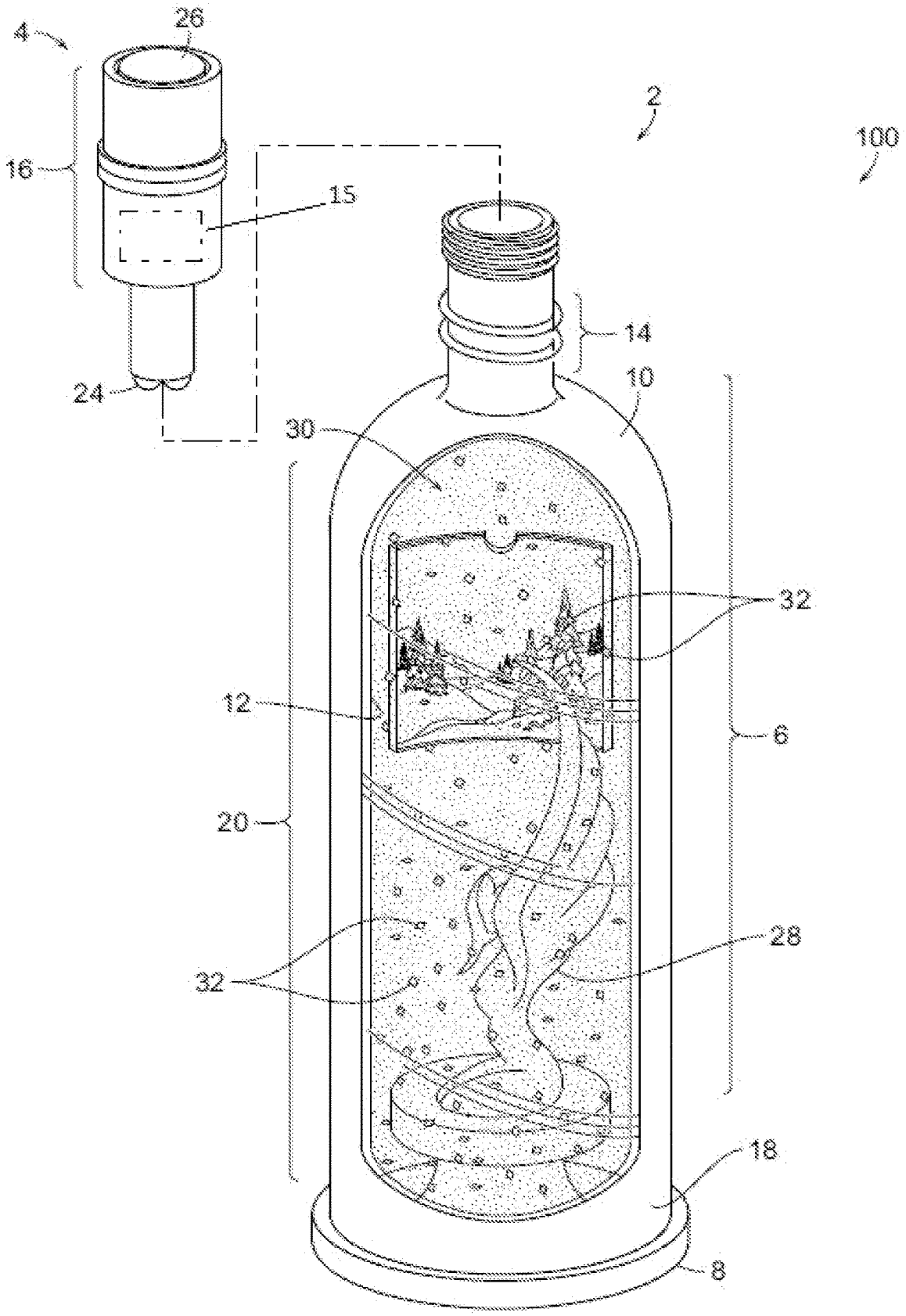
FIG. 1 is a frontal view of a snow-themed bottle, according to at least some embodiments disclosed herein.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

FIG. 1 is a frontal view of a snow-themed bottle, according to at least some embodiments disclosed herein.

According to FIG. 1, a first embodiment 100 of a snow-themed bottle is depicted. The snow-themed bottle may include: a top portion 2, a middle portion 6, and a bottom portion 18. The top portion 2 may be located near a first end 4 of the snow-themed bottle and the bottom portion 18 may be located new a second end 8 of the snow-themed bottle, where the first end 4 is disposed opposite the second end 8. The middle portion 6 may be disposed between the top portion 2 and the bottom portion 18.

In this example, the top portion 2 may have a first width, the middle portion 6 may have a second width, and the bottom portion 18 may have the second width. A circumference of the first width of the top portion 2 may be smaller than the circumference of the second width of both the middle portion 6 and the bottom portion 18.

In some examples, the second end 8 may be wider than the top portion 2. In other embodiments, the second end 8 may be narrower than the top portion 2. A door or hatch (not shown) may be disposed on an underside of the second end 8. The door may be accessible via a twist and lock mechanism. In at least one embodiment, the door may be opened via a slot and coin (or other similarly situated device) to provide access to the recess covered by the door. In at least one embodiment, the recess is configured to be sized and shaped to store the theme cards 38 (see FIG. 3). In other embodiments, the recess may contain a music playing device that may be activated by a user action such as but not limited to a wind-up mechanism. A fan in the second end may also be utilized to help disperse the plurality of particles 32. The second end 8 may generally be comprised of any material including but not limited to polymers, metals, wood, composites, and the like or some combination thereof.

In some examples, the top portion 2 may include a neck portion 14, a closure portion 16, and an opening. The closure portion 16 may be located at the first end 4. The neck portion 14 may be located between the closure portion 16 and a hollow inner shell 12 of the middle portion 6. In examples, the opening may extend through the neck portion 14 to the hollow inner shell 12. The opening may also be configured to house one or more lights 24.

In some examples, the one or more lights 24 may be integrated into the neck portion 14. In examples, the one or more lights 24 may be light-emitting diode (LED) lights, but the one or more lights 24 are not limited to such lights and can be any light. An outer portion of the neck portion 14 may also include a switch 26 such that when a user engages the switch 26 to an on position, the one or more lights 24 located within the opening turn on and are configured to illuminate the hollow inner shell 12 of the middle portion 6 of the snow-themed bottle. In at least one embodiment the lights will slowly dim when turned off or when the power source is deactivated. This will provide a particular ambiance to the apparatus as opposed to a simple "turn on/turn off" configuration.

In examples, an interior portion of the neck portion 14 may also include a removable battery cartridge 15 configured to charge the one or more lights 24. Such a battery cartridge 15 may be waterproof or water resistant to prevent damage to the batteries and the cartridge. In another embodiment, the cartridge may be separated by a wall or membrane from the fluid contained within the body of the device. The top portion 2 may be threaded to allow the top portion 2 to be removed thereby providing access to the battery cartridge 15. In yet another embodiment, there may be a power saver or battery saver mode wherein the power source is activated via a button supplies power for a predetermined or configurable amount of time. In yet another embodiment, there is an accelerometer and/or gyroscope coupled to the power source that allows that embodiment to detect movement of the bottle. Detection of movement of the bottle may cause an activation of the power source thereby lighting the bottle as described herein. In yet another embodiment, the power source of a USB power source. This may allow for a rechargeable battery to be used in conjunction with the USB power source or the USB power source to be used as a standalone device.

As depicted and in some examples, the middle portion 6 may have a substantially cylindrical shape such that the top portion 2 may extend from the substantially cylindrical shape of the middle portion 6 and become tapered towards the first end 4. As depicted, the snow-themed bottle may be shaped like a wine bottle but is not limited to such shape and other shapes are contemplated herein.

In this example, the middle portion 6 may include an outer surface 10 configured to house a hollow inner shell 12. The outer surface 10 may be substantially opaque in color and may include a first transparent viewing window 20. In examples, the hollow inner shell 12 may include: an ornament 28 affixed to the bottom portion 18, a clear fluid 30 (e.g., a liquid medium), and a plurality of particles 32.

When a user shakes the snow-themed bottle, the plurality of particles 32 rise up, using the clear fluid 30 as a medium to obtain buoyancy and movement, such that the plurality of particles 32 circulate through the clear fluid 30 in an unpredictable motion. The motion of the plurality of particles 32 simulates snow fall such that the plurality of particles 32 fall slowly to the bottom portion 18 of the snow-themed bottle.

It should be appreciated that the clear fluid 30 may be water or any other clear liquid. In some examples, glycerin may be added to the clear fluid 30 (e.g., water in this example) to allow the plurality of particles 32 to fall slower than a snow-themed bottle utilizing pure water as the clear fluid 30. The ornament 28 may be a figurine, a design, a figure, a landscape, a miniaturized scene, a model, a trophy, an artistic expression, and a landmark, among other examples. The ornament 28 is not limited to any specific length, width, or height parameters or examples so long as the ornament 28 can fit within the snow-themed bottle. It should also be appreciated that the ornament 28 is not limited to any specific colors, themes, or lettering. In additional examples, two or more ornaments may be included within the snow-themed bottle. As an illustrative example, a first ornament depicting a snowman and a second ornament depicting a gift or present may both be inserted into the snow-themed bottle and affixed to the bottom portion 18 for a snow-themed bottle having an overall holiday or winter theme.

In examples, the plurality of particles 32 may include lightweight particulate matter. Each particle of the plurality of particles 32 may be of any shape, size, and color. It should be appreciated that the plurality of particles 32 may be made of any material, such as plastic. In some examples, the particles may be made of a polyvinyl chloride (PVC) material.

According to some examples, each particle of the plurality of particles 32 may be of a shape. The shape may be a one-dimensional shape, a two-dimensional shape, and a three-dimensional shape. In some examples, if each particle of the plurality of particles 32 is a two-dimensional shape, the shape may include: a henagonal shape, a diagonal shape, a triangular shape, a quadrilateral shape, a pentagonal shape, a hexagonal shape, a heptagonal shape, an octagonal shape, a nonagonal shape, a decagonal shape, a hendecagonal shape, a dodecagonal shape, a tridecagonal shape, a tetradecagonal shape, a pentadecagonal shape, a hexadecagonal shape, a heptadecagonal shape, an octadecagonal shape, an enneadecagonal shape, and an icosagonal shape.

In other examples, if each particle of the plurality of particles 32 is a two-dimensional shape, the shape may include at least one arc. In this example, the two-dimensional shape comprising the at least one arc may include: an annulus, an arbelos, a circle, a circular sector, a circular segment, a crescent, an indalo, a lense, a lune, a reuleaux polygon, a salinon, a semicircle, a tomahawk, a triquetra, and a heart.

Figure 2:
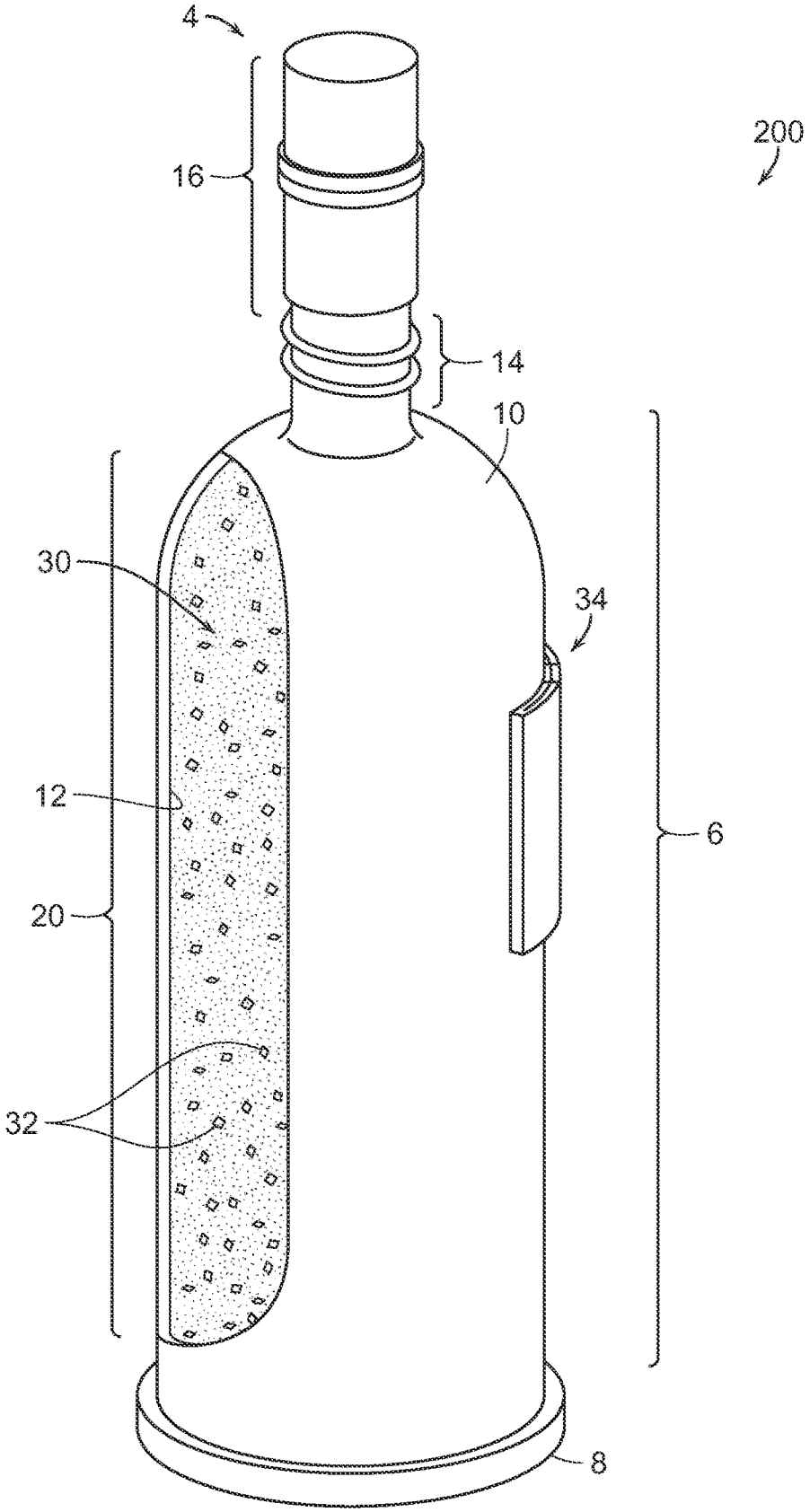
FIG. 2 is a side view of a snow-themed bottle, according to at least some embodiments disclosed herein.

FIG. 2 is a side view of a snow-themed bottle, according to at least some embodiments disclosed herein.

According to FIG. 2, a side view 200 of the snow-themed bottle of FIG. 1 is depicted. As explained with reference to FIG. 1, the snow-themed bottle may include a top portion 2 (of FIG. 1), a middle portion 6, and a bottom portion 18 (of FIG. 1). The top portion 2 (of FIG. 1) may be located near a first end 4 of the snow-themed bottle and the bottom portion 18 (of FIG. 1) may be located new a second end 8 of the snow-themed bottle, where the first end 4 is disposed opposite the second end 8. The middle portion 6 may be disposed between the top portion 2 (of FIG. 1) and the bottom portion 18 (of FIG. 1).

In some examples, the top portion 2 (of FIG. 1) may include a neck portion 14, a closure portion 16, and an opening. The closure portion 16 may be located at the first end 4. The neck portion 14 may be located between the closure portion 16 and the hollow inner shell 12 (of FIG. 1) of the middle portion 6. In examples, the opening may extend through the neck portion 14 to the hollow inner shell (of FIG. 1) of the middle portion 6.

As depicted and in some examples, the middle portion 6 may have a substantially cylindrical shape such that the top portion 2 (of FIG. 1) may extend from the substantially cylindrical shape of the middle portion 6 and become tapered towards the first end 4. Such shape of the snow-themed bottle may be described as a wine bottle shape. It should be appreciated that any shape is contemplated for the snow-themed bottle and the shape is not limited to the shape depicted herein.

In this example, the middle portion 6 may include an outer surface 10 configured to house a hollow inner shell 12 (of FIG. 1). The outer surface 10 may be substantially opaque in color and may include a first transparent viewing window 20. The first transparent viewing window 20 may be located on a first side of the outer surface 10. The hollow inner shell 12 (of FIG. 1) of the middle portion 6 may include a second transparent viewing window 34 affixed to an inside portion of the hollow inner shell 12 (of FIG. 1) at the second side. The second side may be disposed opposite the first side.

Figure 3:
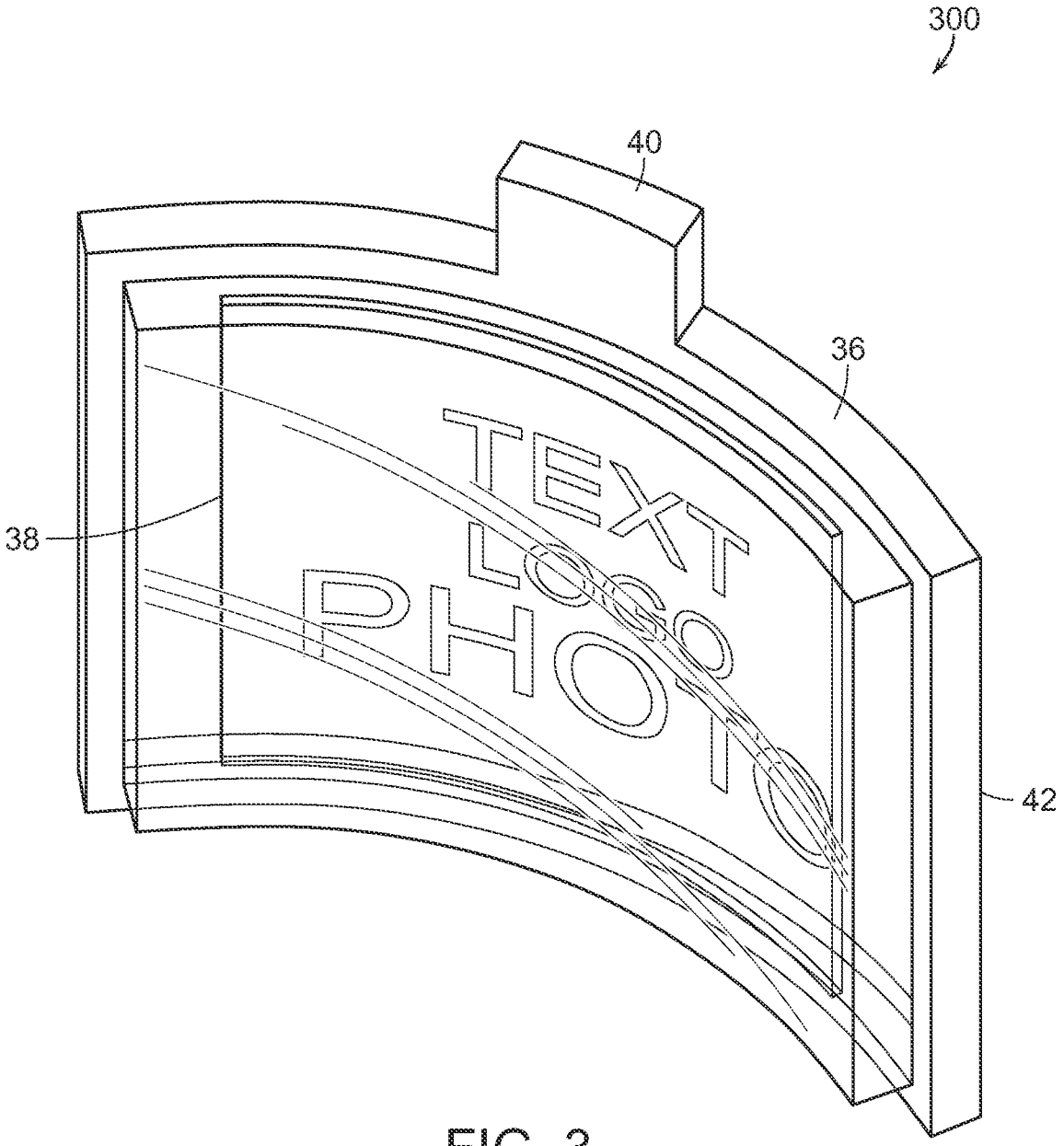
FIG. 3 is a depiction of a frame configured to be housed in a slot component affixed to a side of an outer surface of a middle portion of a snow-themed bottle, according to at least some embodiments disclosed herein.

FIG. 3 is a depiction of a frame configured to be housed in a slot component affixed to a side of an outer surface of a middle portion of a snow-themed bottle, according to at least some embodiments disclosed herein.

According to FIG. 3, a depiction 300 of a frame 36 is provided. As explained previously in FIG. 1 and FIG. 2, the snow-themed bottle may include a top portion 2 (of FIG. 1), a middle portion 6 (of FIG. 1 and FIG. 2), and a bottom portion 18 (of FIG. 1). The top portion 2 (of FIG. 1) may be located near a first end 4 (of FIG. 1 and FIG. 2) of the snow-themed bottle and the bottom portion 18 (of FIG. 1) may be located new a second end 8 (of FIG. 1 and FIG. 2) of the snow-themed bottle, where the first end 4 (of FIG. 1 and FIG. 2) is disposed opposite the second end 8 (of FIG. 1 and FIG. 2). The middle portion 6 (of FIG. 1 and FIG. 2) may be disposed between the top portion 2 (of FIG. 1) and the bottom portion 18 (of FIG. 1).

The snow-themed bottle may include an outer surface 10 (of FIG. 1 and FIG. 2) configured to house a hollow inner shell 12 (of FIG. 1). The outer surface 10 (of FIG. 1 and FIG. 2) may be substantially opaque in color and may include a first transparent viewing window 20 (of FIG. 1 and FIG. 2). The first transparent viewing window 20 (of FIG. 1 and FIG. 2) may be located on a first side of the outer surface 10 (of FIG. 1 and FIG. 2). The hollow inner shell 12 (of FIG. 1) of the middle portion 6 (of FIG. 1 and FIG. 2) may include a second transparent viewing window 34 (of FIG. 2) affixed to an inside portion of the hollow inner shell 12 (of FIG. 1) at the second side. The second side may be disposed opposite the first side such that the first transparent viewing window 20 (of FIG. 1 and FIG. 2) is disposed opposite the second transparent viewing window 34 (of FIG. 2).

In other embodiments, there may be no second transparent viewing window, or the viewing window may be opaque. Here, when there is no theme card 38 present a standard logo, image, etc. may be seen by the viewer that is emblazoned on the rear portion.

Figure 4:
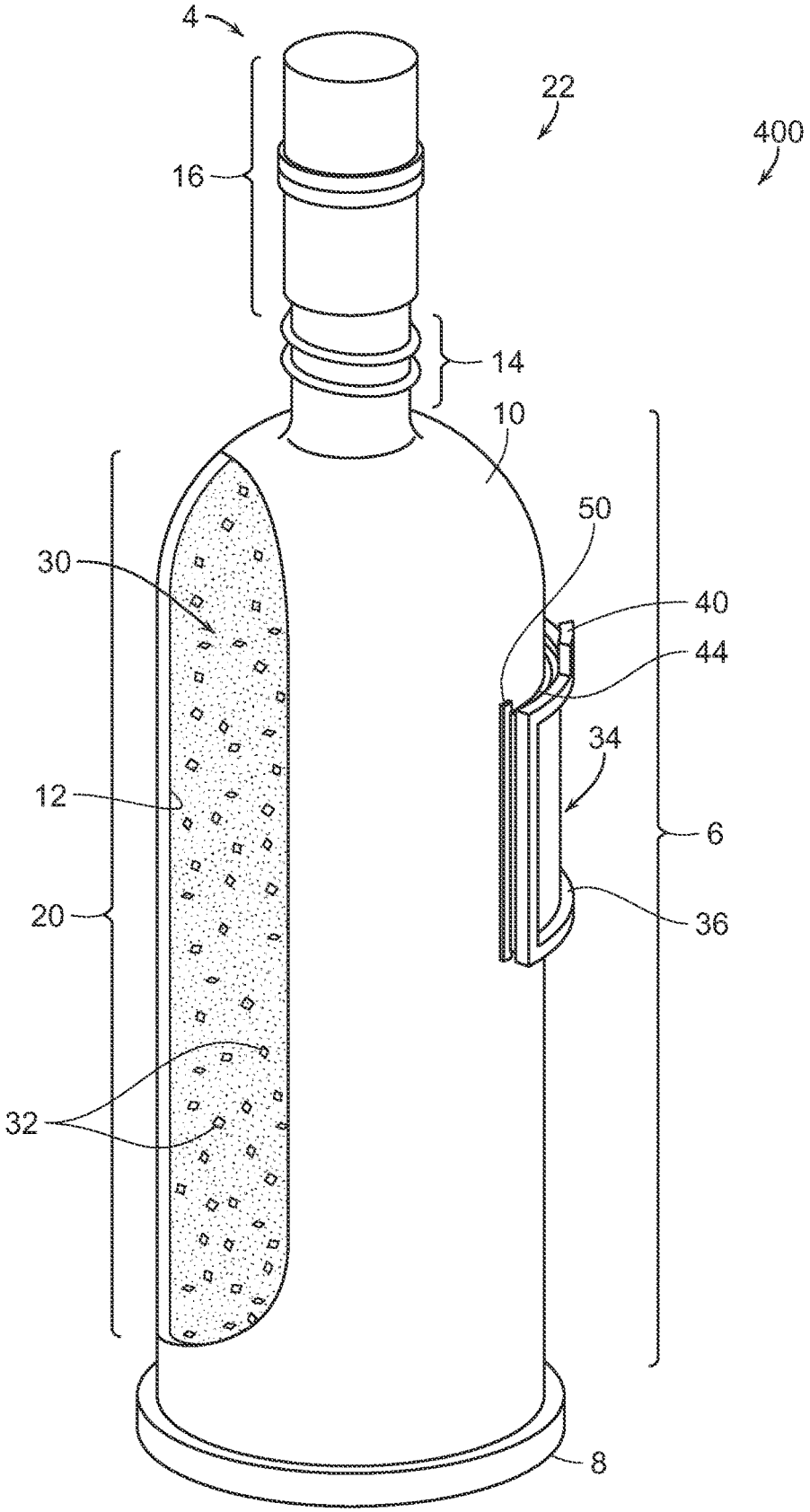
FIG. 4 is another side view of a snow-themed bottle with a slot component affixed to a side of an outer surface of a middle portion, according to at least some embodiments disclosed herein.

Further, the outer surface 10 (of FIG. 1 and FIG. 2) may additionally house a slot component 44 (of FIG. 4). The slot component 44 (of FIG. 4) may be affixed to the second side of the outer surface 10 (of FIG. 1 and FIG. 2). The slot component 44 (of FIG. 4) is configured to house a frame 36. The frame 36 may include an optional ornamental knob 40 and molding 42 surrounding the outside of the frame 36. The frame 36 may be configured to house at least one theme card 38 and may be configured to hold more than one theme card 38.

In an example, a theme card of the at least one theme card 38 may include one or more images, colors, letters, and text on a front side. The theme card of the at least one theme card 38 may additionally include the one or more images, the colors, the letters, and the text identically on a back side opposite the first side. In other examples, the theme card of the at least one theme card 38 may additionally include differing images, colors, letters, and text on the back side. In at least one embodiment, the snow-themed bottle is designed to magnify the imagery disposed on the at least one theme card 38.

In some examples, a user may insert the theme card of the at least one theme cards 38 into the frame 36 such that the front side of the theme card faces the first side of the outer surface 10 (of FIG. 1 and FIG. 2) and the back side faces the second side of the outer surface 10 (of FIG. 1 and FIG. 2). The placement of the theme card allows a user to view the front side of the theme card through the first transparent viewing window 20 (of FIG. 1 and FIG. 2) and the back side of the theme card through the second transparent viewing window 34 (of FIG. 2). In some embodiments, the second transparent viewing window 34 is opaque and thus no imagery is seen through the second transparent viewing window 34. In other embodiments, a standard image is present on an interior of this viewing window such that when no theme card 38 is present in the frame 36, the standard, stock image is viewable.

It should be appreciated that the user may easily change the theme card by lifting the frame 36 out of the slot component 44 (of FIG. 4) and removing the theme card from the frame 36. As explained, the present invention and its embodiments provide a user-customizable snow-themed bottle, where the user may customize a theme of the snow-themed bottle by modifying: the at least one theme card 38 insertable into the snow-themed bottle, parameters (e.g., a shape, color, or texture) of the plurality of particles 32 (of FIG. 1) located within the snow-themed bottle, and an ornament 28 (of FIG. 1) (e.g., scene) located within the snow-themed bottle. Therefore, the user may customize the snow-themed bottle in infinite ways to provide visual entertainment or to increase the sentiment of gifts or souvenirs.

Such customizability allows the user to use the snow-themed bottle in a number of different settings, including personal settings and business relations. In a first illustrative example, the user may own a legal business or law firm. The user may wish to provide snow-themed bottles to prospective customers as a way to advertise the legal business or law firm, and/or may provide the snow-themed bottles to employees as a holiday gift. In this example, the plurality of particles 32 (of FIG. 1) may be shaped like legal gavels and may be of one or differing colors. Further, a theme card of the at least one theme card 38 may be utilized that includes a name or slogan of the legal business or law firm. The ornament 28 (of FIG. 1) may also be customized to showcase a name of the legal business or the law firm.

In a secondary example, the user may purchase snow-themed bottles to give as gifts to family members during the holidays. In this example, the plurality of particles 32 (of FIG. 1) may be made of a plastic material and may be white in color to reflect snow. A theme card of the at least one theme card 38 may include a family portrait and may be utilized and inserted into the frame 36. In this example, the ornament 28 (of FIG. 1) may be a snowman or other holiday figurine.

In another example, a parent may purchase the snow-themed bottles to give as a gift to those children and adults who attend a child's birthday party. In this scenario, the plurality of particles 32 (of FIG. 1) may be made of different colored glitter to simulate a party atmosphere. A theme card of the at least one theme card 38 may include a photograph of the birthday boy or girl. In this example, the ornament 28 (of FIG. 1) may include a present or birthday cake figurine.

In yet another example, a tourist may purchase the snow-themed bottles as a souvenir when traveling to a new location, such as a new state or country. For illustration purposes, this example assumes that the country is the United States of America. In this example, a theme card of the at least one theme card 38 may include a photo of a bald eagle or an image of one or more iconic places or locations within the United States, such as an image of Time Square or the Empire State building in New York City. In this scenario, the plurality of particles 32 (of FIG. 1) may be made of different colors, such as the colors of the American flag: a red color, a white color, and a blue color. In this example, the ornament 28 (of FIG. 1) may include a figurine of the Statute of Liberty. As shown and described in these examples, the user-customizability of the plurality of particles 32 (of FIG. 1), the ornament 28 (of FIG. 1), and the at least one theme card 38 allows the user to infinitely modify the product with any artistic and creative expression the user wishes.

FIG. 4 is another side view of a snow-themed bottle with a slot component affixed to a side of an outer surface of a middle portion, according to at least some embodiments disclosed herein.

According to FIG. 4, another side view 400 of a snow-themed bottle is provided. As explained with reference to FIG. 1, FIG. 2 and FIG. 3, the snow-themed bottle may include a top portion 2 (of FIG. 1), a middle portion 6 (of FIG. 1 and FIG. 2), and a bottom portion 18 (of FIG. 1). The top portion 2 (of FIG. 1) may be located near a first end 4 of the snow-themed bottle and the bottom portion 18 (of FIG. 1) may be located new a second end 8 of the snow-themed bottle, where the first end 4 is disposed opposite the second end 8. The middle portion 6 (of FIG. 1 and FIG. 2) may be disposed between the top portion 2 (of FIG. 1) and the bottom portion 18 (of FIG. 1).

The snow-themed bottle may include an outer surface 10 configured to house a hollow inner shell 12 (of FIG. 1). The outer surface 10 may be substantially opaque in color and may include a first transparent viewing window 20. The first transparent viewing window 20 may be located on a first side of the outer surface 10. The hollow inner shell 12 (of FIG. 1) of the middle portion 6 (of FIG. 1 and FIG. 2) may include a second transparent viewing window 34 affixed to an inside portion of the hollow inner shell 12 (of FIG. 1) at the second side. The second side may be disposed opposite the first side such that the first transparent viewing window 20 is disposed opposite the second transparent viewing window 34.

Further, the outer surface 10 may additionally house a slot component 44. The slot component 44 may be affixed to the second side of the outer surface 10. The slot component 44 is configured to house a frame 36. The frame 36 may include an optional ornamental knob 40 and molding 42 (of FIG. 3) surrounding the outside of the frame 36. The frame 36 may be configured to house at least one theme card 38.

Additionally, the outer surface 10 may have a track or securement device 50 disposed thereon. This securement device 50 may be a magnetic material or strip of magnetic material configured to magnetically attract the second viewing window apparatus 34. In yet another embodiment, the securement device 50 is a tongue and groove mechanism configured to receive a compatible structure present on the second viewing window 34. In some embodiments, there is a recess in a portion of the outer surface 10 that allows a read surface of the second viewing window 34 to be flush with an outer surface of the outer surface 10. In such an embodiment, the securement device 50 may be housed within the recess.

In an example, a theme card of the at least one theme card 38 may include a front side disposed opposite a back side. The theme card of the at least one theme card 38 may include one or more images, colors, letters, and text on the front side. The theme card of the at least one theme card 38 may additionally include the one or more images, the colors, the letters, and the text identically on the back side. In other examples, the theme card of the at least one theme card 38 may additionally include differing images, colors, letters, and text on the back side.

In some examples, a user may insert the theme card of the at least one theme cards 38 into the frame 36 such that the front side of the theme card faces the first side of the outer surface 10 and the back side of the theme card faces the second side of the outer surface 10. The placement of the theme card allows a user to view the front side of the theme card through the first transparent viewing window 20 and the back side of the theme card through the second transparent viewing window 34.

As explained in FIG. 3, it should be appreciated that the user may easily change the theme card by lifting the frame 36 out of the slot component 44 and removing the theme card from the frame 36. As explained, the present invention and its embodiments provide a user-customizable snow-themed bottle, where the user may customize a theme of the snow-themed bottle by modifying the at least one theme card 38 insertable into the snow-themed bottle, parameters (e.g., a shape, a color, a size, or a texture) of the plurality of particles 32 (of FIG. 1) located within the snow-themed bottle, and the ornament 28 (of FIG. 1)/miniaturized scene located within the snow-themed bottle. Therefore, the user may customize the snow-themed bottle in infinite ways to provide visual entertainment or to increase the sentiment of gifts or souvenirs. Further, the apparatus may play a song or play a light show (light patterns, colors, etc.) upon activation. The song and/or light show may or may not correspond to the theme card 38 which is used in conjunction with the apparatus.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

Furthermore, although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A snow-themed bottle comprising:

a top portion extending from a substantially cylindrical body portion and becoming tapered towards a first end, wherein the top portion has a first width;

a bottom portion located at a second end, wherein:

the bottom portion has a second width, and the first end is disposed opposite the second end; and a substantially cylindrical body portion located between the top portion and the bottom portion, wherein:

the substantially cylindrical body portion has the second width, a circumference of the first width is smaller than the circumference of the second width, and the substantially cylindrical body portion comprises:

an outer surface configured to house a hollow inner shell, the outer surface comprising:

a first transparent viewing window located on a first side of the outer surface; and a slot component affixed to a second side of the outer surface, wherein:

the first side is disposed opposite the second side, and the slot component is configured to house a frame; and the hollow inner shell comprising:

a second transparent viewing window;

an ornament affixed to the bottom portion;

a clear fluid;

a plurality of particles;

wherein the outer surface and hollow inner shell are opaque except for the first transparent window and the second transparent window.

2. The snow-themed bottle of claim 1, wherein the second transparent viewing window is disposed on an opposite side of the snow themed bottle from the first transparent viewing window.

3. The snow-themed bottle of claim 1, wherein the top portion comprises a neck portion located between a closure portion and the hollow inner shell, and wherein the closure portion is located at the first end.

4. The snow-themed bottle of claim 3, wherein the top portion comprises an opening extending through the neck to the hollow inner shell, and wherein the opening is configured to house one or more lights.

5. The snow-themed bottle of claim 4, wherein an outer portion of the neck portion comprises a switch such that when the switch is turned to an on position, the one or more lights are turned on and are configured to illuminate the hollow inner shell of the snow-themed bottle.

6. The snow-themed bottle of claim 4, wherein an interior portion of the neck portion comprises a removable battery cartridge configured to charge the one or more lights.

7. The snow-themed bottle of claim 1, wherein the frame is configured to house at least one theme card.

8. The snow-themed bottle of claim 7, wherein each theme card of the at least one theme card comprises a component selected from the group consisting of: an image, a color, and text.

9. A snow-themed bottle comprising:

a top portion located at a first end;

a bottom portion located at a second end, wherein the first end is disposed opposite the second end; and a middle portion located between the top portion and the bottom portion, wherein the middle portion comprises:

an outer surface configured to house a hollow inner shell, the outer surface comprising:

a first transparent viewing window located on a first side of the outer surface; and a slot component affixed to a second side of the outer surface, wherein:

the first side is disposed opposite the second side, the slot component houses a frame and the frame is configured to house at least one theme card; and the hollow inner shell comprising:

a second transparent viewing window located inside and affixed to an inside portion of the hollow inner shell at the second side;

an ornament affixed to the bottom portion;

a clear fluid; and a plurality of particles.

10. The snow-themed bottle of claim 9, wherein a shape of the middle portion is selected from the group consisting of: a globe shape, a cylindrical shape, and a rectangular shape.

11. The snow-themed bottle of claim 9, wherein the top portion comprises:

a neck portion located between a closure portion and the hollow inner shell, the closure portion located at the first end; and an opening extending through the neck to the hollow inner shell, the opening being configured to house one or more lights.

12. The snow-themed bottle of claim 11, wherein an outer portion of the neck portion comprises a switch such that when the switch is turned to an on position, the one or more lights are turned on and are configured to illuminate the hollow inner shell of the snow-themed bottle.

13. The snow-themed bottle of claim 11, wherein an interior portion of the neck portion comprises a removable battery cartridge configured to charge the one or more lights.

14. The snow-themed bottle of claim 9, wherein the at least one theme card comprises a component selected from the group consisting of: an image, a color, and text.

15. The snow-themed bottle of claim 9, wherein each particle of the plurality of particles comprise a shape selected from the group consisting of: a one-dimensional shape, a two-dimensional shape, and a three-dimensional shape.

16. The snow-themed bottle of claim 15, wherein:

each particle of the plurality of particles comprises the two-dimensional shape, and the two-dimensional shape is selected from the group consisting of: a henagonal shape, a diagonal shape, a triangular shape, a quadrilateral shape, a pentagonal shape, a hexagonal shape, a heptagonal shape, an octagonal shape, a nonagonal shape, a decagonal shape, a hendecagonal shape, a dodecagonal shape, a tridecagonal shape, a tetradecagonal shape, a pentadecagonal shape, a hexadecagonal shape, a heptadecagonal shape, an octadecagonal shape, an enneadecagonal shape, and an icosagonal shape.

17. The snow-themed bottle of claim 15, wherein:

each particle of the plurality of particles comprises the two-dimensional shape, the two-dimensional shape comprises at least one circular arc, and the two-dimensional shape comprising the at least one arc is selected from the group consisting of: an annulus, an arbelos, a circle, a circular sector, a circular segment, a crescent, an indalo, a lense, a lune, a reuleaux polygon, a salinon, a semicircle, a tomahawk, and a *triquetra*.

18. A snow-themed bottle comprising:

a top portion located at a first end;

a bottom portion located at a second end, wherein the first end is disposed opposite the second end; and a middle portion located between the top portion and the bottom portion, wherein the middle portion comprises:

an outer surface configured to house a hollow inner shell, the outer surface comprising:

a first transparent viewing window located on a first side of the outer surface; and a slot component affixed to a second side of the outer surface, wherein:

the first side is disposed opposite the second side, the slot component houses a frame the frame is configured to house at least one theme card and the frame being magnetically coupled to the slot component, and the at least one theme card comprises a component selected from the group consisting of: an image, a color, and text; and the hollow inner shell comprising:

a second transparent viewing window located inside and affixed to an inside portion of the hollow inner shell at the second side;

an ornament affixed to the bottom portion;

a clear fluid; and a plurality of particles.

19. The snow-themed bottle of claim 18, wherein a shape of the middle portion is selected from the group consisting of: a globe shape, a cylindrical shape, and a rectangular shape.

* * * * *